United States Patent [19]

Kina et al.

[11] Patent Number: 4,522,904

[45] Date of Patent: Jun. 11, 1985

[54] ELECTROPHOTOGRAPHIC PROCESS

[75] Inventors: Hideki Kina; Toshiyuji Iijima, both of Nagano; Eizo Tanabe, Kanagawa; Toyoki Kazama, Kanagawa; Masaharu Namba, Kanagawa, all of Japan

[73] Assignees: Fuji Electric Company, Ltd.; Fuji Electric Corporate Research & Development, Ltd., both of Kanagawa, Japan

[21] Appl. No.: 421,852

[22] Filed: Sep. 23, 1982

[30] Foreign Application Priority Data

Oct. 8, 1981 [JP] Japan ..... 56-160802
Oct. 8, 1981 [JP] Japan ..... 56-160803

[51] Int. Cl.[3] ..... G03G 13/00
[52] U.S. Cl. ..... 430/54; 355/14 E
[58] Field of Search ..... 430/31, 54; 355/14 E

[56] References Cited

U.S. PATENT DOCUMENTS 3,645,729 2/1972 Goffe ..... 430/57 X
4,119,373 10/1978 Frishman et al. ..... 430/55 X
4,377,628 3/1983 Ishioka et al. ..... 430/67 X

*Primary Examiner*—John D. Welsh
*Attorney, Agent, or Firm*—Brumbaugh, Graves, Donohue & Raymond

[57] ABSTRACT

In the specific embodiments described herein, the charge drop resulting from fatigue in an electrophotographic process using an a-Se:H photosensitive member is reduced by a stabilization exposure carried out for one to three cycles prior to use of the member for image formation. Longer wavelength light may be used for the stabilization exposure and shorter wavelength light may be used for the imaging and discharge steps.

10 Claims, 5 Drawing Figures

ELECTROPHOTOGRAPHIC PROCESS

BACKGROUND OF THE INVENTION

This invention relates to a charge stabilization method for a photosensitive member in an electrophotographic process, and more particularly to an electrophotographic process using as photosensitive members amorphous silicon containing hydrogen (a-Si:H). The electrophotographic process includes charging and exposing steps for making latent images on a photosensitive member, developing and transferring steps for making reproductions from images on the photosensitive member, and discharging and cleaning steps.

Generally, the photosensitive member is employed repeatedly in the electrophotgraphic process to obtain a plurality of image reproductions. However, in order to obtain good image quality and reproduction of images continuously, it is desirable that the electrophotographic apparatus have sufficient adaptability relative to the photosensitive member to perform effective charging, exposing, discharging and the like and that any change in performance of the system resulting from fatigue of the photosensitive member resulting from the repeated use thereof, is reduced as much as possible.

Zinc oxide (ZnO), cadmium sulfide (CdS), organic semiconductors (OPC) such as polyvinyl carbazole (PVK), and amorphous selenium (a-Se) system materials have been known as photosensitive materials for electrophotography. However, ZnO has a problem associated with the durability since the photosensitivity is low and the light fatigue effect is high. Because the photosensitive film of CdS is produced by dispersing CdS in a binder, it is difficult to control the characteristics of the film, which results in a lower sensitivity. In addition, CdS films have a durability problem since the surface of the film is made porous to reduce its resistance to humidity. OPCs have had great promise because of the diversity of the available materials. However, they have many disadvantages including lack of stability resulting from the ozone generated by corona discharge, low wear resistance, and lack of stability resulting from external factors such as heat, light and the like. In comparison with these photosensitive materials, a-Se system materials are widely used at present, since they provide the advantages of high sensitivity, low fatigue and long life. However, they have the disadvantages that the glass transition temperature (Tg) and the crystallization temperature (Tc) are quite low, except for photosensitive layers made of $As_2Se_3$ materials, and that the light fatigue effect is somewhat high in case of the photosensitive layer of $As_2Se_3$ materials.

Recently, a-Si:H materials have been developed (e.g. Japanese Published Application No. 54-78135) as photosensitive films which do not have the above-mentioned disadvantages of known photosensitive materials. Such a-Si:H photosensitive materials are provided with excellent characteristics with respect to the sensitivity, heat resistance and wear resistance.

However, although a-Si:H materials have good performance as described above, there has been little information about the application of such materials in the electrophotographic process. As a result of a careful investigation, the present inventors have found that the charging performance of a-Si:H photosensitive films depends to a large extent upon the irradiation light to be used. That is, such films have the disadvantage that, because the light fatigue of the material resulting from irradiation light is high, the charge acceptance is reduced by repeated use of the photosensitive film, causing the reproduction or image quality to deteriorate.

BRIEF SUMMARY OF THE INVENTION

Accordingly, it is an object of the present invention to overcome the above mentioned disadvantages of electrophotographic systems using a-Si:H photosensitive materials as electrophotographic films and to provide a process for obtaining stable charging conditions when such films are used.

In accordance with the invention, an a-Se:H photosensitive material used in an electrophotographic process is first exposed to light and is then used to form an image to be reproduced. Preferably, the initial exposure is made using light having a long wavelength, above about 600 nanometers (nm) and it may be made over several cycles, preferably one to three cycles, of operation. On the other hand, the image exposing light and the discharging light preferably are principally, i.e. at least 70%, of shorter wavelength, such as less than about 600 nm. The electrophotographic process of this invention may be used in copiers, non-impact printers (CRT printers, laser printers, etc.), laser facsimile equipment, and the like.

BRIEF DESCRIPTION OF THE DRAWINGS

The preferred embodiments of the invention will be described hereinafter with reference to the accompanying drawings, in which.

DETAILED DESCRIPTION OF PREFERRED EMBODIMENTS

Figure 1:
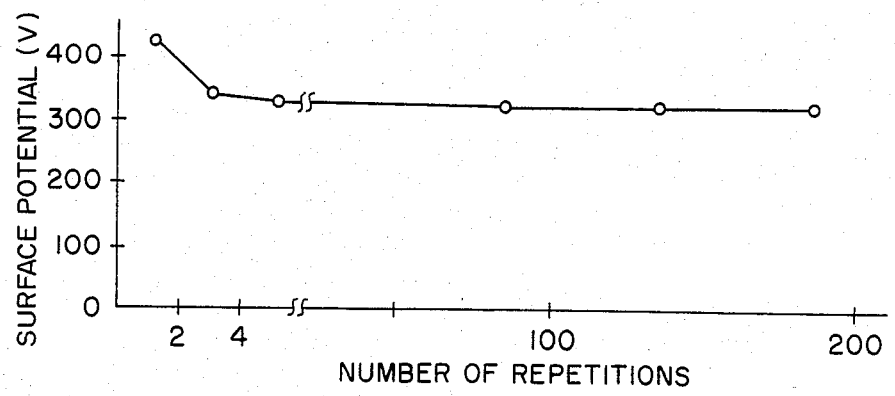
FIG. 1 is a graphical representation illustrating the charging characteristic of a-Si:H system photosensitive film for electrophotography.

It has been found that, in conventional electrophotographic processes using white light for image exposure and discharging, the change in surface potential with repeated exposure and charging steps follows the pattern shown in FIG. 1. As shown in that illustration, the the initial change in surface potential between successive cycles is high, but the surface potential becomes stable after many repetition cycles. Accordingly, the object of the present invention will be accomplished by stabilizing the charging condition by carrying out one to three light exposure steps before starting the electrophotographic process to form an image.

Figure 2:
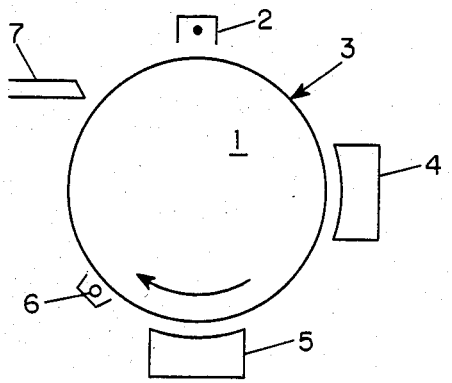
FIG. 2 is a schematic illustration of a portion of an electrophotographic apparatus for carrying out the electrophotographic process according to the present invention.

In the schematic illustration of FIG. 2, a photosensitive member 1, produced by depositing an a-Si:H photosensitive layer on a surface of a drum substrate, is surrounded by a charging unit 2, an image exposure station 3, a developing unit 4, a transferring unit 5, a light source 6 for discharging or neutralizing residual charges on the photosensitive member, and a cleaning blade 7 for cleaning the surface of the photosenstive member. All of those components may be of any conventional type known to those skilled in the art.

In accordance with the invention the initial reduction in the surface potential of an a-Si:H photosensitive member is eliminated by using a light source, such as the light source 6, to irradiate the photosensitive layer for a few cycles of operation so as to accomplish charge stabilization before a series of image production cycles comprising the actual copying process is started. As a result, the initial reduction in surface potential, or charge drop, as shown in FIG. 1 will be eliminated to provide a stable charge condition during the copying process. It is preferable not to carry out too many stabilization exposures because they greatly increase the time required for a first copy to be made. Accordingly, the initial stabilization to be made is preferably accomplished by carrying out one to three successive charge and exposure cycles. In the embodiment just described, only the light irradiation step was carried out in the stabilization treatment. If desired, however, the charging step or the developing step may also be carried out at this time. In addition, the exposure light at the exposure station 3, rather than the discharging light 6, may be applied to the photosensitive member in the stabilization step.

The present invention as described above can be carried out using a light source composed mainly of short wavelength light, below 600 nm, as the exposure light and/or the discharge light utilized in the electrophotographic process.

Another method for carrying out the present invention is based on the findings that the degree of the fatigue of photosensitive member depends upon the wavelength range of the irradiation light with respect to the exposure light or the discharge light applied to an a-Si:H photosensitive member, that the fatigue is increased with longer wavelength light, and that the fatigue is reduced with short wavelength light, particularly the light of wavelengths below 600 nm.

Figure 4:
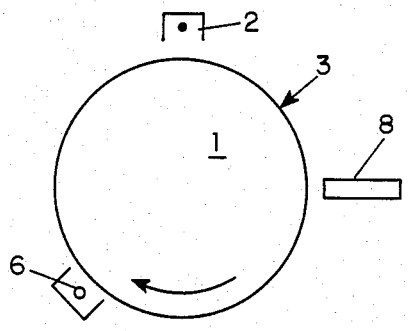
FIG. 4 is a schematic illustration showing an apparatus for evaluating fatique.

In the schematic illustration of FIG. 4, the same reference numerals are used as in FIG. 2, i.e. there is a photosensitive member having an a-Si:H photosensitive layer, a charging unit 2, an image station and exposure 3, a light source 6, for discharging the photosensitive member. In addition, a probe 8 is provided for measuring the surface potential of the electrophotographic layer.

Using the arrangement illustrated in FIG. 4, the charging, exposing and discharging steps were repeated one hundred times, and the reduction of surface potential, or charge drop, was evaluated by determining the difference between the initial surface potential and the surface potential after each cycle for one hundred cycles of repetition. In making the evaluations, exposure and discharge lights having the same wavelengths were used, and, in addition, the wavelength and the intensity of the discharge light were varied. The initial surface potential was 450 V and the amount of the exposure light was selected so as to reduce the surface potential by 50%.

It will be noted that, although the amount of the charge drop varies with the amount of irradiating light, the charge drop is reduced as the wavelength is decreased, and that the amount of the charge drop is very low at wavelengths below 600 nm, particularly below 550 nm. The reason for this may be as follows:

Although a portion of the light directed to the surface of the photosensitive member may be reflected, another portion of the light may enter into the interior thereof. The depth of penetration may be different according to the absorption coefficient of the material at the different wavelengths. In experiments made by the inventors on an a-Si:H member, the following results were obtained:

| | | |
|---|---|---|
| Absorption coefficient | 3 to 5 $\times 10^4$ $cm^{-1}$ at | 500 nm |
| " | 1 to 1.5 $\times 10^4$ $cm^{-1}$ | 600 nm |
| " | 3.5 to 4.5 $\times 10^3$ $cm^{-1}$ | 650 nm |
| " | 1.3 to 2.5 $\times 10^3$ $cm^{-1}$ | 700 nm |

Accordingly, the light having a wavelength shorter than 600 nm may be absorbed in the surface layer within 1 μm, of the top surface and the electron-hole pairs generated may immediately cancel positive charges on the surface. However, the light with the wavelenth of 700 nm, for example, may pass into the layer to a depth greater than 10 μm. Therefore, a portion of the charge carriers generated in the interior of the layer may be trapped by the trapping sites and then released in the charging process to form a volume space charge, thereby causing fatigue as a result of a reduction of the surface potential and an increase in the dark decay. Consequently, the fatigue phenomenon can be significantly reduced by using an exposure light having a short wavelength below 600 nm whose absorption coefficient is less than $1\times 10^4$ $cm^{-1}$.

Figure 3:
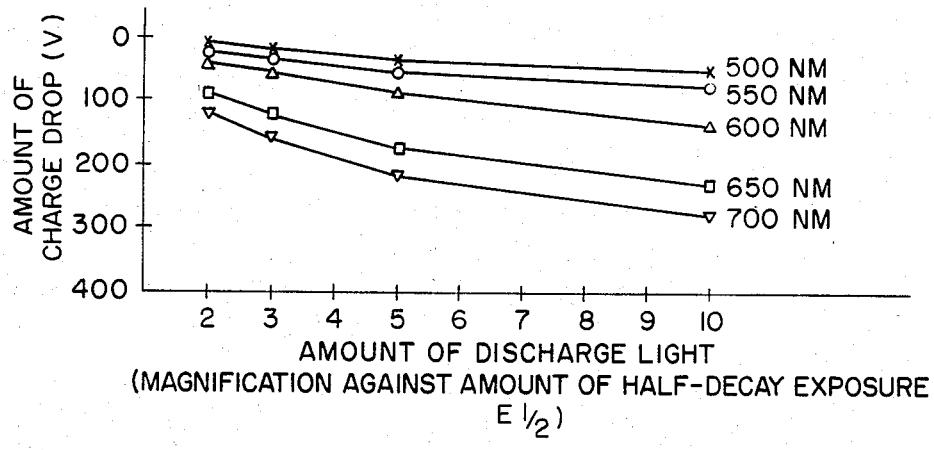
FIG. 3 is a graphical representation showing the degree of charge drop with respect to the wavelength of irradiation light.

The degree of fatigue may also depend upon the amount of irradiating light. As is apparent from FIG. 3, the charge drop will be reduced as a light source with a longer wavelength is used and as the amount of irradiating light is increased. On the other hand, when light with wavelength of 600 nm is used as the discharge light, no perceptible fatigue will be obtained even when the photosensitive layer is exposed to about five times as much light as the amount required for halfdecay exposure ($E_{\frac{1}{2}}$). In addition, when the photosensitive layer is irradiated with light of short wavelength, for example, 500 nm, there is no significant charge drop even if the amount of light used is about twenty times the amount required for half-decay (not shown) as well as ten times that amount. This means that when the light with a wavelength below 600 nm is employed, sufficient amounts of exposure and/or discharge light can be provided without generating fatigue in the photosensitive member.

The results of continuous operation of a copier of the type shown in FIG. 2 will now be described. The film thickness of the photosensitive layer of the a-Si:H photosensitive member 1 used in the copier was 15 μm.

Continuous copies using white light as the image exposure light were made on one hundred sheets with a series of discharge lights 6 having the wavelengths shown in Table 1, the amount of the discharge light being five times $E_{\frac{1}{2}}$. The images of the final copies were then evaluated and the results obtained are shown in Table 1. In addition, for comparison, Table 1 shows experimental results using a white discharge light which is outside the range of the present invention.

TABLE 1

| Wavelength of discharge light (nm) | 500 | 550 | 600 | 650 | white light |
|---|---|---|---|---|---|
| Image evaluation | good | good | possible | bad | bad |

In order to investigate effects in mixing a component of long wavelength discharge light with short wavelength discharge light, continuous copies were made on one hundred sheets using an image exposure light with a wavelength of 550 nm in the apparatus of FIG. 2, and using a varied discharge light composed of a short wavelength component of 550 nm and a long wavelength component of 650 nm comprising from 0 to 40% of the total energy of the discharge light. The results are shown in Table 2, and it will be apparent that good images can be obtained when the proportion of the energy of the long wavelength component is less than 30% of the total energy, particularly less than 20%.

TABLE 2

| Mixing proportion of long wavelength component (%) | 0 | 10 | 20 | 30 | 40 |
|---|---|---|---|---|---|
| Image evaluation | good | good | good | possible | bad |

As will be apparent from the experiments, it is not necessary that only a short wavelength light is used for the image exposure light and/or the discharge light. It is permissible to use light containing a longer wavelength component as long as the energy proportion of the long wavelength light to the total light is below a certain value, specifically below 30%, and preferably below 20%. In addition, it is possible to increase the amount of light for the discharge light and/or the exposure light as shorter wavelengths are used. When light with a wavelength of 500 nm is used, an a-Si:H photosensitive member will have almost no fatigue even if the amount of light is $20\times E_{\frac{1}{2}}$.

Considering the characteristic that the light fatigue described above depends upon the wavelength range of the irradiated light, further evaluation will demonstrate the purpose accomplished by the present invention.

Figure 5:
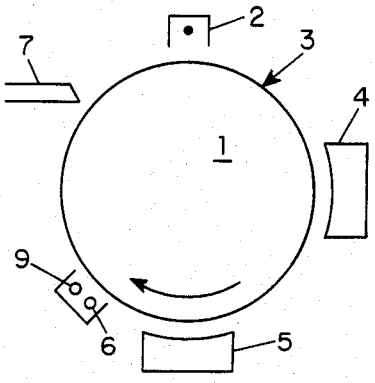
FIG. 5 is a schematic illustration showing a portion of another form of electrophotographic apparatus for carrying out the invention.

FIG. 5 shows one embodiment for carrying out the method, wherein an additional light source 9 is provided for use only in the stabilization step. Since the light source 9 is not employed for the exposure or discharge step, it is possible to use a light source composed primarily of long wavelength components (above 600 nm) or a light source combined with filters for mainly transmitting long wavelength components, whereby the number of cycles in the stabilization step can be reduced. Instead of positioning the light source 9 adjacent to the discharge light 6 as shown in FIG. 5, it may be placed in any other desired position, for example, at a position between the exposure unit 3 and the charging unit 2 or between the charging unit 2 and the cleaning unit 7.

Although white light can be used as the light source 9 for stabilization, it is particularly advantageous to use light composed mainly of long wavelength components as the light source 9 for stabilization, while using light composed mainly of short wavelength components as the exposure light and/or the discharge light employed for the electrophotographic process.

According to the present invention, as described above, it is possible to obtain images having good quality without causing fatigue of the photosensitive member by adding the stabilization step to the electrophotographic process, using either an additional light source or the exposure light and/or the discharge light, having the specified wavelength or wavelength distribution, whereby the practical application of a-Si:H photosensitive members is greatly improved. Further, the improved electrophotographic process is applicable to copiers, non-impact printers (for example, CRT printers, laser printers) and laser facsimile equipment. Although the invention has been described with reference to copier embodiments, it will be understood that the invention is not limited to the copying process and is applicable to other types of apparatus for carrying out the electrophotographic process.

We claim:

1. An electrophotographic process employing a photosensitive member having a layer of hydrogen-containing amorphous silicon comprising the steps of:

exposing the surface of the photosensitive member to a substantially uniform charge stabilization light composed primarily of light having a wavelength above 600 nm at least once for charge stabilization treatment; and thereafter effecting a series of image-producing operations without charge stabilization treatment.

2. An electrophotographic process according to claim 1 wherein the charge stabilization light exposure is applied from a discharge light source for discharging the photosensitive member or from an image exposure light source.

3. An electrophotographic process according to claim 1 wherein the charge stabilization light exposure is applied from a charge stabilization light source which is not used for image exposure or for discharging the photosensitive member.

4. An electrophotographic process according to claim 1 wherein the image producing operations include an image exposure step employing light composed primarily of light having a short wavelength below 600 nm as the image exposure light.

5. An electrophotographic process according to claim 4, wherein the light employed for image exposure consists of light having a short wavelength below 600 nm.

6. An electrophotographic process according to claim 4 wherein the exposure light contains light of a long wavelength above 600 nm having an energy which is less than 30% of the total energy.

7. An electrophotographic process according to claim 1 wherein the image producing operations include the step of exposing the photosensitive member to a discharge light which is composed primarily of light having a short wavelength below 600 nm.

8. An electrophotographic process according to claim 7 wherein the discharge light consists of light having a short wavelength below 600 nm.

9. An electrophotographic process according to claim 7 wherein the discharge light contains light of a long wavelength above 600 nm having an energy which is less than 30% of the total energy.

10. An electrophotographic process according to any one of claims 1-9, wherein the charge stabilization treatment comprises one to three exposures of the photosensitive member to the charge stabilization light.

* * * * *